US006716016B1

(12) United States Patent
Beeck et al.

(10) Patent No.: US 6,716,016 B1
(45) Date of Patent: Apr. 6, 2004

(54) SELF-SEALING COMPACT SPINNERET FOR A MELT SPINNING PROCESS

(75) Inventors: Heinz-Dieter Beeck, Frankfurt am Main (DE); Roland Estelmann, Landau (DE); Rainer Tietze, Nauheim (DE); Andreas Weichel, Usingen (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 140 days.

(21) Appl. No.: 10/018,456

(22) PCT Filed: Jun. 24, 2000

(86) PCT No.: PCT/EP00/05840

§ 371 (c)(1),
(2), (4) Date: Dec. 12, 2001

(87) PCT Pub. No.: WO01/09413

PCT Pub. Date: Feb. 8, 2001

(30) Foreign Application Priority Data

Jul. 30, 1999 (DE) ..... 199 35 982

(51) Int. Cl.[7] ..... D01D 5/00

(52) U.S. Cl. ..... 425/192 S; 425/198; 425/199; 425/382.2; 425/464; 210/453; 210/488; 210/489; 210/498

(58) Field of Search ..... 210/453, 488, 210/489, 498; 425/192 S, 198, 199, 382.2, 464

(56) References Cited

U.S. PATENT DOCUMENTS

| | | | | | |
|---|---|---|---|---|---|
| 3,724,064 | A | * | 4/1973 | Mott | 29/520 |
| 3,768,661 | A | * | 10/1973 | Coates | 210/449 |
| 5,304,052 | A | | 4/1994 | Schroeder et al. | 425/192 S |
| 5,387,097 | A | * | 2/1995 | Scheiber et al. | 425/382.2 |
| 5,601,854 | A | * | 2/1997 | Schroeder et al. | 425/192 S |
| 5,795,595 | A | | 8/1998 | Beeck et al. | 425/198 |

FOREIGN PATENT DOCUMENTS

| | | | |
|---|---|---|---|
| DE | 29 26 533 | | 1/1981 |
| EP | 0623693 | A2 * | 11/1994 |

* cited by examiner

*Primary Examiner*—Robert Davis
*Assistant Examiner*—Joseph S Del Sole
(74) *Attorney, Agent, or Firm*—Herbert Dubno

(57) ABSTRACT

The invention relates to a spinneret for spinning thermoplastics. Said spinneret comprises a central polymer inlet channel, a filter assembly (2), consisting of one or more filter plates of various filtration grades, a spinneret plate (3) and a housing (1) which receives and tightly surrounds the filter assembly (2) and the spinneret plate (3). The selection of suitable materials and tolerances for the individual parts of the spinneret enables the sealing effect to be achieved at operating temperature by the increased expansion of the internal components, in relation to the external housing.

6 Claims, 1 Drawing Sheet

SELF-SEALING COMPACT SPINNERET FOR A MELT SPINNING PROCESS

CROSS REFERENCE TO RELATED APPLICATIONS

This application is a national sage of PCT/EP00/05840 filed 24 Jun. 2000 and is based upon German national application 199 35 982.2 filed 30 Jul. 1999 under the International Convention.

FIELD OF THE INVENTION

The invention relates to a spinneret for the spinning of thermoplastics having a central polymer melt inlet passage, a filter arrangement comprised of one or more filter disks of different filter finenesses or filter grades, a spinneret plate and a housing close-fitting around and receiving the filter arrangement and the spinneret plate.

BACKGROUND OF THE INVENTION

Pressure build-up, shear and filtering of the polymer to be spun in a spinneret are usually accomplished by means of a sand filling as is described for example in U.S. Pat. No. 5,304,052 or U.S. Pat. No. 5,795,595. These sand fillings, whether of steel grit or pure quartz sand, are however associated with various drawbacks: for one, the sand fillings themselves are not identical from spinneret to spinneret even when prepared with the greatest of care and for another there are handling difficulties with respect to filling with sand and the transport of the filled spinnerets. Apart from this, discrete sand grains can render the internal seals of the spinnerets ineffective. These seals formed during the incorporation of the sieve filter, form first of all overflows because of their U shape and also small dead zones, i.e. in the U shaped configurations, exchange is rendered difficult and can result in a decomposition of the polymer. There is also a cost factor. Each component contributes to cost and seals are the origin of ongoing operating costs since they can be used only once and with each nozzle replacement must be renewed. In addition they can provide no absolutely reliable seal as is known in practice since fabrication and mounting defects invariably increase with increasing numbers of the individual parts.

To alleviate some of the drawbacks associated with sand fillings it has been proposed to provide a filter construction as is known for example from DE 29 26 533 C2. Thus a method has been provided in which the individual filter disks are cold-pressed together so that a substantially better filter effect is produced than is the case with an otherwise identical arrangement with loose filter disks. Such cold-sintered filters are provided with a sealing enclosure and are supplied by various suppliers under commercial names like "Porostar" or Multipor". The sealing enclosure can suppress the aforementioned drawbacks.

OBJECT OF THE INVENTION

The object of the present invention is to provide a spinneret for the spinning of thermoplastics which avoids the aforementioned drawbacks both from the point of view of sand fillings as well as the sealing enclosures. As a result the spinneret should have a configuration that is as compact as possible.

SUMMARY OF THE INVENTION

According to the invention a spinneret for spinning thermoplastics has a central polymer melt inlet passage, a filter arrangement comprised of a plurality of filter disks of different filter fineness which are fixedly bonded together by cold pressing, a spinneret plate and a housing which closely surrounds and receives the filter arrangement and the spinneret plate. The filter arrangement has no sealing enclosure and is comprised of a material with a higher thermal expansion coefficient than that of the material from which the housing surrounding it is fabricated.

The spinneret plate can be comprised of a material with a higher thermal expansion coefficient than that of the material from which the housing surrounding it is fabricated. The filter arrangement can have no sealing enclosure and the filter arrangement and the spinneret plate can both be comprised of materials with a higher thermal expansion coefficient than the material from which the housing surrounding them is fabricated. The spinneret plate and/or the filter arrangement can be composed of austenitic steel like for example Nos. 1.4301, 1.4541, 1.4580 or a material with a similarly high thermal expansion coefficient and the housing surrounding them can be fabricated from a material with a lower coefficient of thermal expansion like, for example No. 1.4057 or a similar chromium steel or refractory material.

The dimensioning can be is so selected that the fit between the outer diameter of the spinneret plate and/or the filter arrangement on the one hand and the bore receiving it in the surrounding housing on the other hand provides a slight play fit at room temperature which is transformed at operating temperatures based upon the different expansions of the parts, into a self-sealing radial press fit.

The spinneret plate can be comprised of a material with a higher thermal expansion coefficient than the material of the housing surrounding it and that the spinneret plate can have in its lower half additionally a thread which is directly screwed into the housing whereby the thread and the stop of the spinneret plate in the housing are so formed that the spinning orifice pattern always has the same orientation so that the correct blast on the filaments as they are spun is ensured by the screwing of the spinneret plate to its stop.

The housing can have at its lower end a projecting collar which has at least three grooves for receiving a tool for screwing the spinning system in and out. The spinneret plate can thereby be protected against detrimental contact during handling.

According to the invention, therefore, filter structures of filter disks cold-pressed against one another are used but without the conventional sealing housing by providing them in a housing bore which matches them as precisely as is possible, i.e. a press fit, whereby the material of the filters should have a substantially higher coefficient of thermal expansion than the material of the housing. The sealing of the filter structure is effected at the operating temperature by thermal expansion and with the spinneret plate in an optional manner.

Further it is proposed to fabricate the spinneret plate out of a material with a high coefficient of thermal expansion and to insert it into a bore in the housing which receives it in as close to a matching fit, i.e. a press fit, as is possible. In this case the sealing of the spinneret plate is effected at the operating temperature by thermal expansion. The filter arrangement can be constructed in an optional manner and can be fabricated from a material with an optional coefficient of thermal expansion.

Preferably the filters of the filter disks cold-pressed together as well as the spinneret plates are composed of materials of high coefficients of thermal expansion and both parts are inserted in bores with press fits in a housing fabricated from a material with a lesser coefficient of thermal expansion.

Preferably the spinneret plate is additionally provided with a thread in its lower half and directly screwed into the housing so as to obtain the tight fit sealing seat described previously, the thread and the abutment of the spinneret in the housing being so formed that the spinning hole pattern is always in the same orientation. This ensures that by screwing it in to its abutment or stop, the correct blowing onto the filaments as they are spun out is effected.

Preferably the housing at its lower end is provided with a projecting collar which has at least three grooves for receiving a tool for screwing the spinning system in or out and which protects the spinneret against detrimental contact during the handling.

The filter unit according to the invention avoids the drawbacks of classical sand filtration. The elimination of the conventional sealing results in a significant cost saving and enhanced sealing reliability. By the suitable choice of materials and tolerance of fit of the individual parts of the spinneret according to the invention, the sealing effect is brought about at the operating temperature by the increased expansion of the inner components, namely the filter and/or the spinneret plate, with respect to the outer lying housing, without the requirement for additional elements. Further the short and compact construction is advantageous: cost effective fabrication and easier handling with more uniform and identical filtration from nozzle to nozzle.

BRIEF DESCRIPTION OF THE DRAWING

The detailed description of a preferred embodiment of the invention follows in connection with FIG. 1 which is a cross sectional view of a spinneret arrangement according to the invention.

SPECIFIC DESCRIPTION

Figure 1:
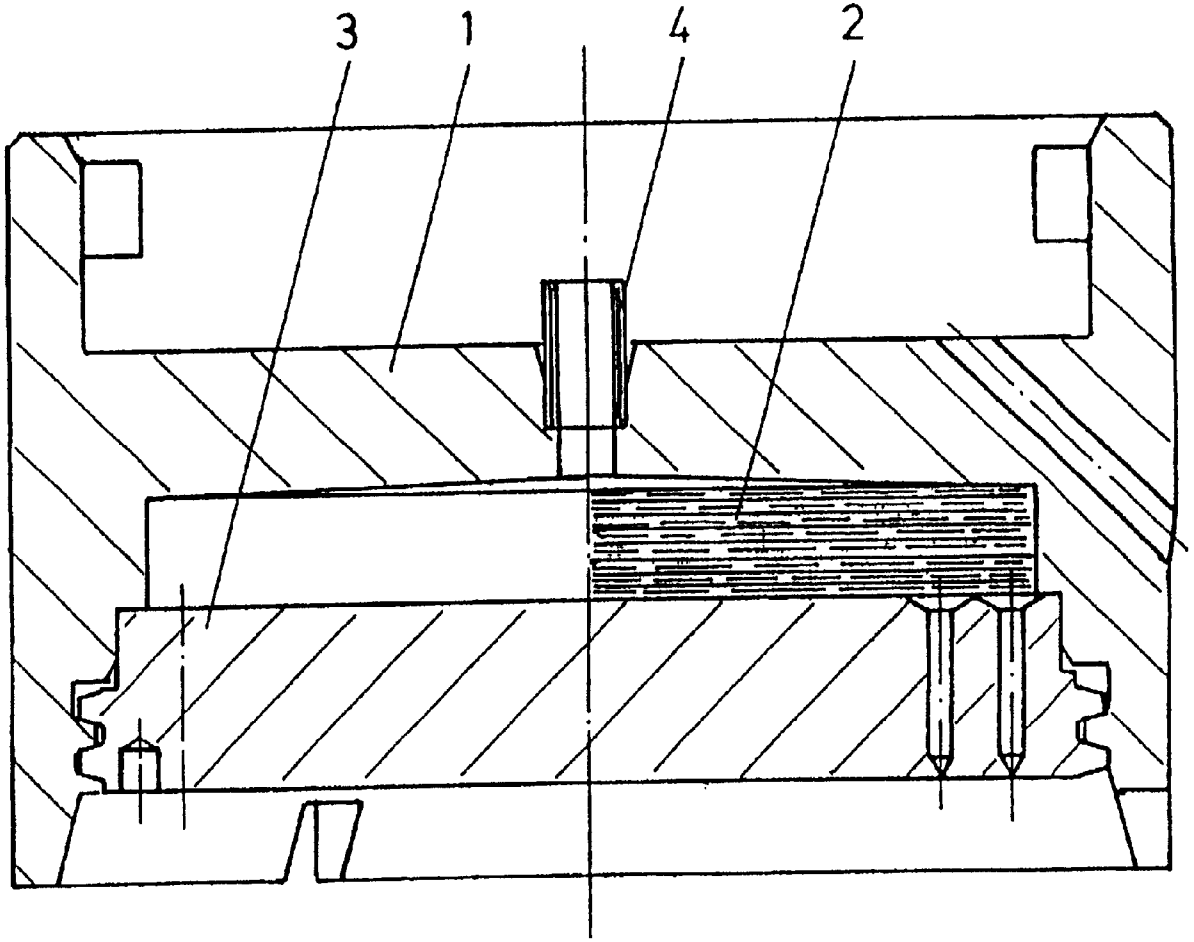

In a housing 1 a cold-sintered filter 2 is disposed. The construction of this filter 2 comprises individual layers of filter disks of different filter fineness, specifically selected for the particular spinning process, on a spinneret plate 3. In this exemplary spinneret arrangement, the spinneret plate 3 is fastened by means of a thread in the housing 1. The thread in the housing 1 and on the spinneret plate 3 are so configured that upon screwing of the plate in until it reaches an abutment or stop the spinning orifice pattern is always located at the same place so that the correct blowing onto the filaments as they are spun out of the orifices can be assured. The connection of the polymer melt supply is effected via the connecting seal 4 and adapter (not here further shown) to the heating vessel (also called the spinning beam). The embodiment can be matched completely to the requirements of the user and the equipment available to him.

The housing 1 is comprised of material No. 1.4057 (according to German Industrial Standard-Steel Key), a material with a relatively low thermal expansion coefficient. The spinneret plate 3 can be composed of material No. 1.4580 and the filter structure 2 of material No. 1.4301 or 1.4541, all materials with a relatively high coefficient of thermal expansion. The fits are so selected with respect to the dimensions and materials that the individual parts, in a cold state can easily be fitted together and disassembled from one another and that the sealing effect on the one hand will result at the latest shortly before the specific spinning temperature is reached and on the other hand the parts at elevated cleaning temperature (about 450–540° C.) will not be damaged by overexpansion.

The desired self-sealing function in the operating state is achieved without conventional seals by the targeted pairing of materials and selection of the fits: the four parts, housing 1, filter 2, spinneret plate 3 and connection seal 4 are mounted together in the cold state and thereafter heated as is customary. Because of the different thermal expansions, the sealing effect arises and the spinneret can spin the filaments at optional pressure. The outer housing 1 is thus comprised of material of a relatively low coefficient of thermal expansion and the inner parts, filter 2 and/or spinneret plate 3 can be fabricated by contrast of a material with a higher thermal expansion coefficient. The dimensions are so selected that the parts can easily be mounted in the cold state (room temperature) but at the operating temperature for spinning (about 300° C.) because of the differential expansion can yield a self-sealing press fit between the parts. Upon termination of spinning, the complete spinneret is subjected to a cleaning and first after cooling is disassembled. Thereafter, the spinneret plate 3 and the filter element 2 which can thus be used primarily like a filter candle, can be further cleaned and scraped or subjected to ultrasound.

The sealing principle here expounded upon using differential thermal expansion is not limited to the described spinnerets and filter uses but can be used universally wherever filtering, shearing or spinning is desired whether for microfibers, textile filaments, high strength tire cords or other applications. It remains for the product or applications expert to select the configuration by the choice of the cold-sintered filter, the materials and the fits for their special cases either by analysis or empirically.

What is claimed is:

1. A spinneret for spinning thermoplastics comprising a central polymer melt inlet passage, a filter arrangement comprising of a plurality of filter disks of different filter fineness which are fixedly bonded together by cold pressing, a spinneret plate and a housing which closely surrounds and receives the filter arrangement and the spinneret plate, said filter arrangement being free from a sealing enclosure and comprised of a material with a higher thermal expansion coefficient than that of the material from which the housing surrounding it is fabricated so that a press-fit seal able to sustain pressure of a polymer melt is formed directly between said filter arrangement and said housing.

2. A spinneret for spinning of thermoplastics comprising a central polymer inlet passage, a filter arrangement consisting of a plurality of filter disks of different filter fineness which are fixedly bonded together by cold pressing with one another, a spinneret plate and a housing closely surrounding and receiving the filter arrangement and the spinneret plate, said filter arrangement being free from any sealing enclosure, said filter arrangement and said spinneret plate being comprised of materials with a higher thermal expansion coefficient than the material from which the housing surrounding them is fabricated so that press-fit seals able to sustain pressure of a polymer melt are formed directly between said filter disks and said housing and between said spinneret plate and said housing.

3. The spinneret according to claim 1 or claim 2 wherein the spinneret plate and the filter arrangement are composed of austenitic steel selected from steel Nos. 1.4301, 1.4541 and 1.4580 with a relatively high thermal expansion coefficient and the housing is fabricated from steel No. 1.4057.

4. The spinneret according to claim 1 or claim 2 wherein the dimensioning is so selected that the fit between the outer diameter of the spinneret plate and the filter arrangement and a bore in the surrounding housing provides a slight play fit at room temperature which is transformed at operating temperatures based upon the different expansions of the parts, into a self-sealing radial press fit.

5. The spinneret according to claim 1 or claim 2 wherein the spinneret plate has a lower half formed with a thread directly screwed into the housing and forming a stop in the housing such that a spinning orifice pattern of the spinneret plate always has the same orientation.

6. The spinneret according to claim 1 or claim 2 wherein the housing has at its lower end a projecting collar which has at least three grooves for receiving a tool for screwing the spinning system in and out and the spinneret plate is thereby protected against detrimental contact during handling.

* * * * *